US009799424B2

(12) United States Patent
Heipel et al.

(10) Patent No.: US 9,799,424 B2
(45) Date of Patent: Oct. 24, 2017

(54) HYBRID CABLE, METHOD FOR ITS MANUFACTURE AND USE OF SUCH A HYBRID CABLE

(71) Applicants: LEONI KABEL HOLDING GMBH, Nuremberg (DE); CONTINENTAL TEVES AG & CO. OHG, Frankfurt (DE)

(72) Inventors: Markus Heipel, Nuremberg (DE); Lazhar Kahouli, Altbach (DE); Hideki Sakai, Yokohama (JP); Akihiro Koeda, Yokohama (JP)

(73) Assignees: LEONI Kabel Holding GmbH, Nuremberg (DE); Continental TEVES AG & Co. oGH, Frankfurt am Main (DE)

( * ) Notice: Subject to any disclaimer, the term of this patent is extended or adjusted under 35 U.S.C. 154(b) by 0 days.

(21) Appl. No.: 15/006,311

(22) Filed: Jan. 26, 2016

(65) Prior Publication Data

US 2016/0141070 A1 May 19, 2016

Related U.S. Application Data

(63) Continuation of application No. PCT/EP2014/070957, filed on Sep. 30, 2014.

(30) Foreign Application Priority Data

Dec. 20, 2013 (DE) ..... 10 2013 226 976

(51) Int. Cl.

| | |
|---|---|
| ***H01B 7/00*** | (2006.01) |
| ***H01B 7/04*** | (2006.01) |
| ***H01B 7/18*** | (2006.01) |
| ***H01B 3/44*** | (2006.01) |
| ***H01B 7/24*** | (2006.01) |
| ***H01B 13/00*** | (2006.01) |
| ***H01B 13/012*** | (2006.01) |
| ***H01B 13/22*** | (2006.01) |

(52) U.S. Cl.

CPC ..... *H01B 7/0045* (2013.01); *H01B 3/441* (2013.01); *H01B 7/04* (2013.01); *H01B 7/1885* (2013.01); *H01B 7/24* (2013.01); *H01B 13/0036* (2013.01); *H01B 13/01209* (2013.01); *H01B 13/22* (2013.01)

(58) Field of Classification Search

USPC ..... 174/50, 7, 72 A

See application file for complete search history.

(56) References Cited

U.S. PATENT DOCUMENTS

| | | | | |
|---|---|---|---|---|
| 4,552,988 | A | 11/1985 | Haderer | |
| 4,755,629 | A * | 7/1988 | Beggs | H01B 11/085 174/115 |
| 5,162,609 | A * | 11/1992 | Adriaenssens | H01B 11/02 174/113 R |
| 6,253,138 | B1 * | 6/2001 | Shober | F16H 59/12 477/34 |
| 6,825,419 | B2 | 11/2004 | Grögl et al. | |
| 7,015,397 | B2 * | 3/2006 | Clark | H01B 11/04 174/113 R |
| 7,208,684 | B2 | 4/2007 | Fetterolf, Sr. et al. | |
| 9,000,301 | B2 | 4/2015 | Hayakawa et al. | |
| 2004/0050582 | A1 * | 3/2004 | Grogl | H01B 7/041 174/120 R |
| 2009/0056974 | A1 * | 3/2009 | Groegl | H01B 7/1895 174/113 R |
| 2013/0277087 | A1 | 10/2013 | Hayakawa et al. | |

FOREIGN PATENT DOCUMENTS

| | | | |
|---|---|---|---|
| CN | 1691212 | A | 11/2005 |
| DE | 10242254 | A1 | 3/2004 |
| EP | 0959547 | A1 | 11/1999 |
| EP | 1589541 | A1 | 10/2005 |
| EP | 2019394 | A1 | 1/2009 |
| JP | S53153489 | U | 12/1978 |
| JP | 2003303515 | A | 10/2003 |
| JP | 2013237428 | A | 11/2013 |

* cited by examiner

*Primary Examiner* — William H Mayo, III
*Assistant Examiner* — Krystal Robinson
(74) *Attorney, Agent, or Firm* — Laurence A. Greenberg; Werner H. Stemer; Ralph E. Locher

(57) ABSTRACT

An electric lead contains at least three conductors. Each of conductors has a line which is surrounded by a conductor sheath. Two of the conductors are embodied as signal conductors, and form, with a common partial lead sheath surrounding them, a first partial lead, in particular a signal lead. Another of the conductors is embodied as a power conductor and forms a second partial lead, in particular a power lead. The conductors are surrounded by a separating sleeve, which is in turn surrounded by a common sheath of the electric lead. The lead is characterized in that the partial lead sheath has an inner sheath section and an outer sheath section, and the outer sheath section is harder than the inner sheath section.

3 Claims, 2 Drawing Sheets

HYBRID CABLE, METHOD FOR ITS MANUFACTURE AND USE OF SUCH A HYBRID CABLE

CROSS-REFERENCE TO RELATED APPLICATION

This is a continuation application, under 35 U.S.C. §120, of copending international application No. PCT/EP2014/070957, filed Sep. 30, 2014, which designated the United States; this application also claims the priority, under 35 U.S.C. §119, of German patent application No. DE 10 2013 226 976.5, filed Dec. 20, 2013; the prior applications are herewith incorporated by reference in their entirety.

BACKGROUND OF THE INVENTION

Field of the Invention

The invention relates to an electric lead, also referred to as a hybrid cable, containing at least three conductors, each having a line which is surrounded by a conductor sheath. Two of the conductors are embodied as signal conductors and form, with a common partial lead sheath surrounding them, a first partial lead, in particular a signal lead. Another of the conductors is embodied as a power conductor and forms a second partial lead, in particular a power lead. The conductors are surrounded by a separating sleeve, which is in turn surrounded by a common sheath of the electric lead. Furthermore, the invention relates to a method for manufacturing such an electric lead and to the use thereof.

Such a lead is described, for example, in U.S. patent publication No. 2013/0277087.

Cables and electric leads are often subjected to mechanical loads. In this context, relatively stringent requirements are placed on the durability and reliability of the lead for safety-critical applications such as, for example, applications in motor vehicles. Particularly axle cabling, such as, for example, signal leads for wheel rotational speed sensors or power leads for supplying power to brakes are usually subject to repeated bending loads, pressure loads and compressive loads. Further loads additionally frequently arise as a result of changing ambient conditions, in particular in such a way that a lead is subjected to different temperature ranges. In addition to the requirements during operation, in particular, certain requirements also arise during the mounting of the lead in the motor vehicle. The lead is frequently provided with connecting elements, in particular plugs, in the course of the mounting process, or additional preparation steps for fitting the lead are carried out.

U.S. patent publication No. 2013/0277087 A1 describes, for example, a complex lead strand in which an ABS sensor cable and a brake cable are surrounded by a common outer sheath. Integrating two cables with different functions in a common lead strand reduces, in particular, the installation space required thereby. The ABS sensor cable additionally contains two conductors which are surrounded by a common inner sheath. In one development, the outer sheath and the inner sheath are each fabricated from a thermoplastic urethane. In order to avoid the two sheaths sticking to one another when the outer sheath is applied, the inner sheath material is additionally cross-linked in one development, and in another development, in contrast, the cross-linking is dispensed with and the inner sheath is surrounded by a separating layer. In one variant, the two cables of the line strand are surrounded by circular shielding, which can also be embodied as a separating layer, wherein the interstices which are formed by the cables are filled with an additional filler material.

Published, European patent application EP 1 589 541 A1 describes a flexible electric energy and control line which contains two signal conductors which are surrounded by inner shielding, and two supply conductors, wherein the total assembly is surrounded by further, outer shielding. In this way, in particular good electrical transmission properties are obtained. The shielding is fabricated in each case from a metalized synthetic non-woven fabric, which is, in particular, slightly elastic such that the inner shielding is pressed by the supply conductors into the interstices formed by the signal conductors. The outer shielding is essentially round, as a result of which it is possible to arrange drain wires in the remaining intermediate spaces, in order to improve the shielding effect further.

A further flexible electric lead is disclosed in published European patent application EP 2 019 394 A1, wherein the lead here contains a core which has a sleeve which can be pressed in and has a sliding layer which is applied thereto.

Published, non-prosecuted German patent application DE 102 42 254 A1 describes an electric cable for connecting movable electrical consumers, in which a plurality of conductors are each surrounded by insulation which has an inner layer and an outer layer, wherein the inner layer is softer than the outer layer. The conductors in turn are surrounded by a common inner sheath. Furthermore, a separating layer made of powder is arranged between the conductors and the inner sheath, as a result of which the inner sheath also fills the interstices formed by the conductors. The separating layer ensures, in particular, relative movability between the conductors and the inner sheath. Similarly to the insulation, the inner sheath is composed of an inner layer facing the conductors, and an outer layer, wherein the inner layer is softer than the outer layer. The design of the inner sheath permits here, in particular, the cable to be prepared for fitting in such a way that only the outer layer is cut through and the inner layer is then torn off.

SUMMARY OF THE INVENTION

The invention is based on the object of specifying a lead which is suitable for safety-critical applications, and satisfies, in the context, in particular stringent requirements made in respect of the durability or robustness or reliability thereof. In particular, in addition to these operational requirements, the lead is also to be as easy as possible to mount, that is to say, in particular, to be as easy as possible to prepare for fitting, and is to be as easy as possible to handle during the mounting process. Furthermore, an object of the invention is to specify a suitable method for manufacturing the lead, and the use thereof.

The electric lead contains at least three conductors, each having a line which is surrounded by a conductor sheath, wherein two of the conductors are embodied as signal conductors, and another of the conductors is embodied as a power conductor. The signal conductors form a first partial lead, in particular a signal lead, and the power lead forms a second partial lead, in particular a power lead. The two partial leads carry out, in particular, respectively different functions during operation, for which reason the electric lead is also referred to as a hybrid cable.

The conductors, in particular all the conductors of the lead, are also surrounded by a separating sleeve, which is in turn surrounded by the common sheath of the electric lead. In other words, the two partial leads are combined by the separating sleeve and the common sheath applied thereto, and in this way they form the electric lead.

The advantages achieved with the invention are, in particular, that the line has particularly good flexural strength and a long service life, in particular in the case of repeated loading. The lead and, in particular, also the signal lead itself are therefore particularly robust, for example with respect to bending loads, tensile loads, compressive loads or pressure loads. The robustness of the signal lead is particularly relevant with respect to its transmission properties. In this context, the signal conductors are advantageously secured non-movably relative to one another, or a relative movement of the signal conductors with respect to one another is at least severely reduced, as a result of which, in particular, fault-free or at least fault-reduced signal transmission is ensured. In particular, in the case of the use of the signal lead in combination with a wheel rotational speed sensor, more precise and robust transmission of a wheel rotational speed signal is ensured, as a result of which, in turn, determination of the speed which is carried out therewith is improved.

The signal conductors are surrounded by a common partial lead sheath, which, in one preferred refinement, has an inner and an outer sheath section, wherein the outer sheath section is harder than the inner sheath section, that is to say is fabricated from a harder material than the inner sheath section. The robustness of the signal lead is improved through this specific selection of material with respect to the different hardnesses of the sheath sections of the partial lead sheath. A particular further advantage of this selection of material arises additionally in the total lead assembly in that the outer, that is to say the harder, sheath section, on the one hand, protects the inner signal conductors, in particular from the other elements of the lead, and, on the other hand, is also sufficiently hard to displace the power conductors which are guided adjacent to the signal lead in the total assembly, in particular to displace them in such a way that punctiform pressure loading of the signal conductors by the power conductors is prevented.

Harder is understood here and in the following to mean, in particular, that the Shore hardness of the harder material has a higher value than that of the material which is relatively soft relative to the latter, that is to say the harder material is harder by a certain number of degrees of Shore hardness. The Shore hardness is suitably determined here by means of a penetration test on the respective material by means of a spring-loaded pin. For example, the testing is carried out according to the standards which are known for determining the degrees of hardness for elastomers and plastic, in particular, by what is referred to as a Shore D test, for determining the Shore D hardness. The outer sheath section is then preferably at least two degrees of Shore D hardness harder than the inner sheath section.

The signal lead is also per se particularly robust, in particular after the preparation of the lead for fitting, that is to say in particular after removal of the common sheath and exposure of the signal lead over a specific length. Owing to the harder outer sheath section, the exposed signal lead is particularly protected, for example with respect to impacts, and at the same time is particularly flexible owing to the softer inner sheath section.

The signal lead serves, in particular, to transmit an electrical signal, for example a sensor signal, while the power lead serves to transmit an electric power and to supply an electrical consumer. For this reason, the power conductor typically has a larger line cross section than the signal conductors. Depending on how the ground connection of the consumer is made, a second power conductor is possibly present; the power lead then contains two conductors. Particularly in the field of motor vehicles it is, however, known to use the bodywork of a motor vehicle as a common ground; in this case, only one power conductor is then required. In the following, it is therefore firstly assumed that there is merely one power conductor, without restriction of the generality. In the case of a second power conductor, both power conductors are then, in particular, embodied in the same way.

Each of the conductors contains a line which is preferably a stranded line fabricated from a plurality of wires. Such stranded lines are significantly more flexible compared to one-piece lines with a similar cross section and therefore contribute advantageously to the flexibility of the hybrid lead. The line is preferably composed of copper, a copper alloy or of aluminum, and is surrounded by a conductor sheath, which is preferably also composed of just one material, that is to say is applied in one layer. Such conductors are particularly easy to fabricate and are preferably made available, for example, as pre-configured conductors in the manufacturing process of the hybrid cable.

The signal conductors are surrounded, in particular for their protection, by a partial lead sheath and in this way form the first partial lead. In the radial direction, the partial lead sheath is divided into two sheath sections, specifically an inner and an outer sheath section. These are fabricated from different materials in such a way that the inner sheath section is softer than the outer one. In this context, the inner sheath section extends preferably approximately up to half of the total radius of the first partial lead, and the outer sheath section extends correspondingly over the rest of the total radius. Particularly when the signal lead is bent, this results in improved compensation between compressive zones and pressure zones. In the context of the entire hybrid cable, the signal conductors are additionally advantageously protected from the outside against mechanical loading, for example against pressure loading by the power conductors which are usually more solid.

For the purpose of manufacture, the two sheath sections are suitably applied in a two-layer method, preferably extruded on. For this purpose, the inner sheath section is firstly applied to the two signal conductors and in the process also fills, in particular, the interstices between the signal conductors. The inner sheath section is additionally preferably applied with a circular outer contour. Subsequently, the outer sheath section is applied to the inner sheath section, wherein the outer sheath section preferably also has a circular outer contour and is then embodied overall in an annular shape.

The distance between the signal lead and the power lead in the hybrid cable can also be set advantageously with respect to the electrical properties by the partial lead sheath and, in particular, by a suitable selection of the total radius during the manufacture of the first partial lead. During operation, possible crosstalk between the signal conductors and power conductors is then prevented or at least reduced owing to the suitably selected distance; the partial lead sheath then acts, in particular, as a spacer element. This function is particularly appropriate in applications in which the signal lead and the power lead are possibly operated simultaneously.

In a suitable alternative or else additionally, it is possible to provide the entire line, one or two partial leads or the respective conductors with separate shielding and in this way to improve the electrical transmission properties. However, if simultaneous transmission by means of the signal lead and power lead does not take place during operation, such additional shielding is, on the other hand, preferably dispensed with, as a result of which the hybrid cable can then be fabricated more simply and cost-effectively overall.

Consequently, in the total assembly of the electric lead, the partial lead sheath which is embodied in a specific way performs, in particular, a plurality of functions: firstly, the signal conductors are protected both in the total assembly and when the signal lead is laid separately; secondly, a particularly high degree of flexibility of the signal conductors is ensured, and thirdly it is possible to set the electrical properties of the total assembly in an advantageous way.

The two partial leads are combined by the common sheath, which is also referred to as outer sheath. The outer sheath has, in particular, a circular outer contour, which is at the same time also the outer contour of the entire hybrid cable. In other words, the outer surface of the common sheath also forms the outer surface of the electric lead. The outer sheath is preferably extruded on and has one layer, that is to say is fabricated from just one material. In order to improve the flexibility of the hybrid cable, the outer sheath is expediently softer than the outer sheath section of the partial sheath. As a result, in particular, displacement of the relatively soft outer sheath material by the relatively hard material of the outer sheath section is then made possible. In a suitable refinement, the entire sheath is softer than the outer sheath section by at least ten degrees of Shore D hardness.

The partial lead sheath of the first partial lead and/or the common sheath of the electric lead are/is preferably formed from a thermoplastic polyurethane elastomer, also referred to as TPE-U. This material is, on the one hand, particularly robust and, on the other hand, easy to process and is frequently also used to manufacture housings for function elements such as, for example, plugs. The construction of a respective sheath from this material then advantageously permits particularly durable integral molding of a housing onto the hybrid cable or the signal lead, that is to say permits particularly easy encapsulation injection molding of the respective sheath. In this context, the material is, in particular, not cross-linked and as a result particularly suitable to be fused on and encapsulation injection molded in a subsequent process step.

The connection between the housing and the sheath is additionally particularly leakproof, since the housing is connected to the sheath in a particularly materially joined and/or precisely fitting fashion during the integral molding on. Penetration of dirt and moisture into the hybrid cable and/or the signal lead is therefore advantageously avoided during operation. In one particularly suitable refinement of the electric lead, a function element is therefore connected to the first partial lead, the function element having a housing which is fabricated from a material which can be connected chemically and/or physically to the material of the outer sheath section. The housing is here, for example, an encapsulation injection molded part, a plug housing or a sleeve. "Can be connected chemically" is understood to mean here, in particular, a materially joined connection of the two materials. In this context, a refinement in which the housing and the corresponding sheath are fabricated from the same material is particularly preferred. In contrast, "can be connected physically" is to be understood as meaning, in particular, precisely fitting attachment of the housing, wherein the housing is secured to the respective sheath, in particular, by static friction. For example, the housing is fabricated as a finished part, is widened by compressed air and is fitted onto the lead or one of the partial leads. After the compressed air is switched off, the housing fits in a form-locking engaging fashion around the corresponding lead and is held particularly tightly by the additional static friction of the two physically connectable materials one against the other. In particular, in the case of the signal lead, the particularly circular refinement of the partial lead sheath owing to the two-layer method which is used contributes to the physical connection, since as a result a particularly precise fit is achieved between the housing and the sheath. The first partial lead is therefore particularly suitable for attaching a housing for a molded element in a leakproof and secure fashion. The concepts described here are, however, not restricted to the first partial lead; instead, chemical and/or physical connection of a housing, in particular to the entire sheath of the hybrid cable or a sheath of the second partial lead, is also correspondingly advantageously possible. In the case of thermoplastic polyurethane elastomer, the degree of hardness can additionally be easily set by selecting the material composition, and is therefore particularly suitable for constructing the partial lead sheath with different degrees of hardness of the sheath sections. The partial lead sheath is then composed overall of a plurality of materials, in particular only two, which have different degrees of hardness but are both thermoplastic polyurethane elastomers and can be connected to one another during the manufacture of the partial lead sheath in a particularly secure fashion, that is to say in a materially joined fashion. In this way, a partial lead sheath is made available which has varying hardness in the radial direction but can be removed in one piece when preparing the first partial lead for fitting, that is to say in particular when removing the insulation. The selection of material which is described accordingly provides advantages both during the operation of the hybrid cable and also during the handling thereof during the mounting, in particular during the preparation for fitting.

In one advantageous refinement, the conductor sheath of the conductor which is embodied as a power conductor is softer than the outer sheath section. Similarly to the softer common sheath which is described above, this provides the advantage that the conductor sheath of the power lead yields when the signal line is subjected to mechanical loading, as a result of which the signal conductors are in turn protected. Additionally, the signal conductors are also expediently each surrounded in a similar way by a conductor sheath, which is softer than the outer sheath section, wherein, in particular, the same material is used for all the conductor sheaths.

At least one conductor sheath, expediently all the conductor sheaths, are preferably formed from polyethylene, in particular from a cross-linked polyethylene. The latter is also referred to as XLPE. This material is easy to process, has an advantageous sliding effect and is additionally available, in particular, with a degree of hardness which is preferably between the respective hardness of the inner sheath section and that of the outer sheath section. The conductor sheaths of the signal conductors are therefore relatively hard with respect to the inner sheath section surrounding them, and the conductor sheath of the power conductor is relatively soft compared to the outer sheath section which bears against it. As a result, it is, in particular, possible to use the same material for all the conductor sheaths and at the same time to ensure correspondingly improved flexibility.

In order, in particular, to permit the insulation of at least one of the conductors, preferably of all the conductors, to be removed without residue, the respective conductor is embodied in such a way that a conductor separating layer which is embodied as a hot seal layer is arranged between the line of the conductor and the conductor sheath of the conductor. The hot seal layer which is applied, in particular, without gaps delimits the conductor sheath with respect to the line, and has advantageously improved sliding properties compared to the line material, with the result that it is possible to remove the insulation particularly easily and with reduced application of force. When the conductor is manufactured, the hot seal layer is firstly applied, in particular, as a film to the line. The sheath is then extruded on, wherein the hot seal layer is connected to the sheath material in such a way that the hot seal layer is advantageously also pulled off without residue when the insulation is removed.

The partial leads form a partial lead bundle which is surrounded by the separating sleeve, wherein in one preferred refinement the separating sleeve is adapted to the outer contour of the partial lead bundle. In this context, "adapted" is to be understood as meaning, in particular, that the separating film follows, in the cross section of the hybrid cable, the contour which is formed by the partial lead bundle and correspondingly rests in the interstices of the partial lead bundle. In this context, an additional filler material is advantageously dispensed with, as a result, in particular, a corresponding additional process step is avoided during the manufacture.

In a suitable refinement, the separating sleeve is a synthetic non-woven fabric or a plastic film, that is to say, in particular, generally a separating film which is fabricated from a plastic. In contrast to a separating film made of powder, when the insulation is removed a separating film can be particularly easily removed without residue and therefore simplifies the preparation of the lead for fitting. Removal without residue is additionally particularly significant during the subsequent integral molding on of function elements. In the case of a powder separating layer, the lead would firstly have to be cleaned of remaining powder before encapsulation of the respective lead by injection molding. In one preferred refinement, the partial leads are therefore embodied without separating means, that is to say are not provided on their outer sides with a separating means, in particular not with a powdery or pasty separating means. As a result, additional cleaning is avoided. Instead, when a separating film is used, the film can be pulled off, in particular, together with the common sheath and can advantageously be removed without residue. Generally, any continuous film material or layered material can be used as a separating sleeve, for example a non-woven material, a paper material, a textile material or a combination thereof. However, a plastic material, which is, in particular, metalized, is particularly preferred, since the plastic material has at the same time, in particular, suitable tearing off behavior and good stability and flexibility.

In one suitable development, the separating sleeve, in particular the separating film, is applied running in longitudinally to the two partial leads. Such a longitudinally running in separating film has particularly favorable tearing off behavior, as a result of which, in turn, preparation of the hybrid cable for fitting is simplified. Since application in a longitudinally running in fashion has a significantly increased process speed, compared, for example, to taping, such a hybrid cable can be manufactured particularly quickly, that is to say also with correspondingly higher numbers per unit of time.

In order to attach the separating sleeve, it is preferably laid around the partial lead bundle with a specific longitudinal seam overlap and with a specific width. The longitudinal run-in is preferably carried out in a spiral fashion. In this context, the separating sleeve is preferably applied during the twisting of the partial leads with one another and is correspondingly also applied with a twist in such a way that the longitudinal seam follows the twisted profile of the partial leads in a spiral shape. This means, in particular, that the longitudinal seam extends longitudinally along the partial leads, in contrast to taping which usually takes place separately and is therefore more costly in terms of process engineering. In one suitable alternative, the separating sleeve is not applied until after the partial leads are combined, before or while the common sheath of the hybrid cable is applied. In this case, the longitudinal seam extends in a straight fashion in the longitudinal direction of the hybrid cable. The common sheath is then applied, preferably extruded on. The insertion of the separating film into the interstice is then preferably carried out by means of the contact pressure when the common sheath is applied. The longitudinal seam overlap is then selected, in particular, in such a way that the longitudinal seam overlap which remains after the application of the common sheath is as small as possible.

The lines of the signal conductors, that is to say, in particular, the wires thereof, are preferably fabricated from a copper alloy which has an improved sliding behavior compared to pure copper and therefore contributes to the flexibility of the signal lead. However, since significantly more line material is required to fabricate the power conductor owing to the cross section which is larger compared to the signal conductors, the line is preferably fabricated from copper, and therefore at least more favorably as a copper alloy. In order, nevertheless, to achieve a sliding behavior for the power conductor which is also improved, the wires of the power conductor are expediently stranded to one another using a specific method to form a limb stranded conductor: for this purpose, the wires of the conductor are firstly combined to form a plurality of bundles, and each of the bundles is twisted in a limb direction of lay to form a limb. These limbs are in turn twisted to form a limb stranded conductor. In this context, one of the limbs is a central limb the limb direction of lay of which is opposed to the limb direction of lay of the other limbs surrounding it, and around which limb these other limbs are stranded in the opposition direction to their limb direction of lay.

For example, the line contains seven limbs in a 1+6 stranding arrangement. Here, the wires of the internally guided limb, that is to say the central limb, are twisted in the opposite direction to the wires of the respective outer bundles. In the contact region between the outer limbs and the central limb, the wires then advantageously run in criss-cross fashion, as a result of which they are prevented from slipping one into the other when the conductor is bent. The stranding of the outer limbs occurs with the opposite lay to the limb direction of lay of these bundles, as a result of which the flexibility of the conductor is improved, in particular since the individual wires run in a more straight fashion compared to a refinement with long lay. Overall, a conductor which is embodied as a limb stranded conductor according to the above method therefore exhibits improved mechanical behavior and an improved compensation of the position of the wires in the case of combined loading.

As a result of the combination of this specific stranding with copper as a line material, it is then possible, in particular in the case of the power conductor, to manufacture a conductor with a particularly good sliding and bending behavior from copper which is more cost-effective compared to a copper alloy. The specific stranding is additionally also suitable in principle for the signal conductors which, on the basis of a consideration of the fabrication outlay compared to the material costs, are, however, as described above preferably fabricated from a copper alloy and then, in particular, stranded in the conventional way. In this context, the signal conductors preferably each have a line which is embodied as a stranded conductor, wherein the lines are embodied with a common stranded conductor direction of lay. The signal conductors are then preferably twisted with a long lay with respect to this stranded conductor direction of lay, which results in particularly advantageous electrical transmission properties.

In order to improve the mechanical properties of the respective conductor further, the twisting of the wires of this conductor is suitably carried out with a lay length of at least 60 mm and at maximum 150 mm, preferably approximately 100 mm. In this context, the diameter of a wire is approximately between 0.05 mm and 0.11 mm. The diameter of a respective partial lead is then, in particular, approximately between 3 mm and 11 mm.

In order, in particular, to achieve stress-free stranding of the wires of a respective limb, the limbs are stranded with respect to one another with reverse rotation. In this context, the corresponding feed spools are not secured during the stranding but instead are rotated counter to the direction of rotation of the stranding cage, as a result of which the individual limbs and, in particular, the wires thereof in the assembly are advantageously present with reduced torsion.

According to one preferred refinement, in the total assembly of the electric lead the conductors of the first partial lead are twisted with one another and these are subsequently twisted with the power conductor of the second partial lead. In particular, in the case of a plurality of power conductors, the latter are firstly twisted with one another and finally the first partial lead is twisted with the second partial lead.

After the application of the common sheath, which is, in particular, the outermost sheath of the lead, the lead preferably has an outer diameter of 7 mm to 11 mm. As a result, the lead is suitable, in particular, for use in the field of motor vehicles. In this context, the first partial lead expediently serves as a signal lead and is connected to a wheel rotational speed sensor in the motor vehicle, and the second partial lead serves as a power lead and is connected to an electric brake actuator, in particular a parking brake of the motor vehicle.

The twisting and triple stranding described above advantageously ensure immunity to interference in such a way that a signal can be transmitted by means of the signal line and electrical power for supplying an actuator can be transmitted by the power line at the same time. As a result it is possible to use the electric parking brake also as an emergency brake. In other words, the power line is not used to transmit power merely in a state of rest, for example when the motor vehicle is stationary or parked, but also advantageously in a dynamic state, as required.

Instead of function elements only being prepared for fitting and integrally formed on once the electric lead is mounted, it is also possible to manufacture the lead completely with function elements attached thereto. In one particularly suitable refinement, a function element, in particular a rotational speed sensor, is connected to an end of the first partial lead, the function element having a housing which is connected in a materially joined fashion to the outer sheath section. In addition, in a suitable development the other end of the first partial lead and/or the ends of the second partial lead are each provided with a plug.

Other features which are considered as characteristic for the invention are set forth in the appended claims.

Although the invention is illustrated and described herein as embodied in a hybrid cable, a method for its manufacture and a use of such a hybrid cable, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
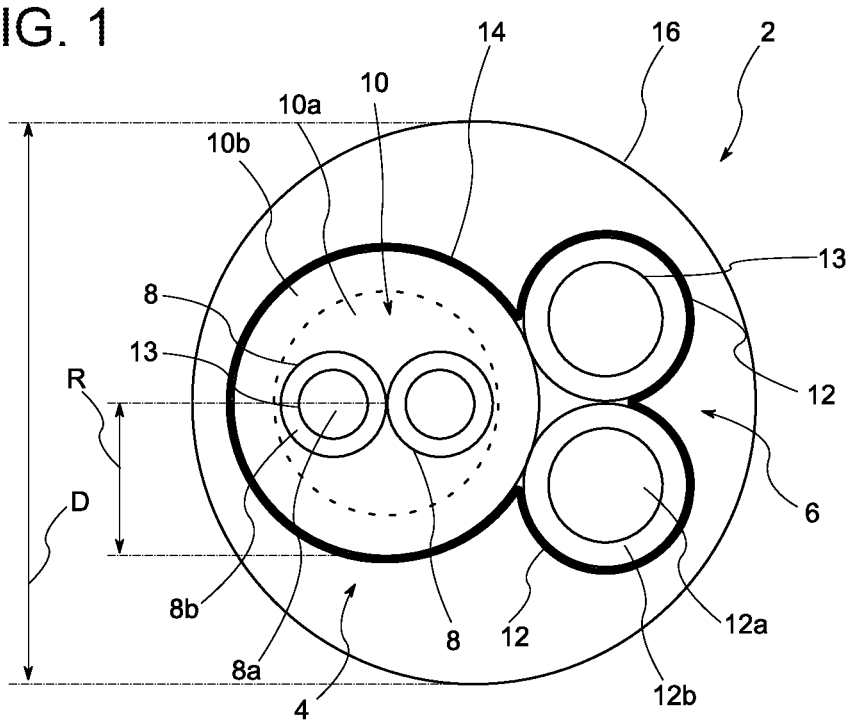
FIG. 1 is a cross-sectional view of an electric lead according to the invention.

Referring now to the figures of the drawings in detail and first, particularly to FIG. 1 thereof, there is shown an electric lead 2 which is embodied as a hybrid lead and in this respect contains two partial leads 4, 6. In this context, the first partial lead 4 is here a signal lead which has two signal conductors 8 which are surrounded by a common partial lead sheath 10. The second partial lead sheath is, in contrast, embodied here as a power lead and contains in this respect two power conductors 12 with a larger cross section than the signal conductors 8 and without a common partial lead sheath. The conductors 8, 12 each comprise a line 8*a*, 12*a* and a conductor sheath 8*b*, 12*b* which respectively surrounds the latter. In order, in particular, to facilitate separation of the respective conductor sheath 8*b*, 12*b*, a conductor separating layer 13, embodied here as a hot seal layer and connected in a materially joined fashion to the respective conductor sheath 8*b*, 12*b*, is arranged between the conductor sheath 8*b*, 12*b* and the associated line 8*a*, 12*a*.

The partial lead sheath 10 of the first partial lead 4 is embodied here with two layers, wherein first an inner sheath section 10*a* surrounds the two signal conductors 8, and in this context also fills the interstices formed between the signal conductors 8. The inner sheath section 10*a* additionally has a circular outer contour. In the radial direction, an outer sheath section 10*b* adjoins the inner sheath section 10*a*, the outer sheath section 10*b* being embodied here, in particular, in an annular shape. In this context, the outer sheath section 10*b* is fabricated from a harder material than the inner sheath section 10*a* and is connected thereto in a materially joined fashion.

In the exemplary refinement shown here, both sheath sections 10*a*, 10*b* are fabricated from a thermoplastic polyurethane elastomer, wherein the material composition is varied in such a way that the outer sheath section 10*b* is harder. The junction between the inner and the outer sheath sections 10*a* and 10*b*, respectively, is indicated in FIG. 1 by a dashed line. In this context it becomes clear that the outer sheath section 10*b* extends approximately over the half the entire radius R of the signal line 4 and at the same time serves, in particular, also as a spacer element between the signal conductors 8 and the power conductors 12.

Figure 2:
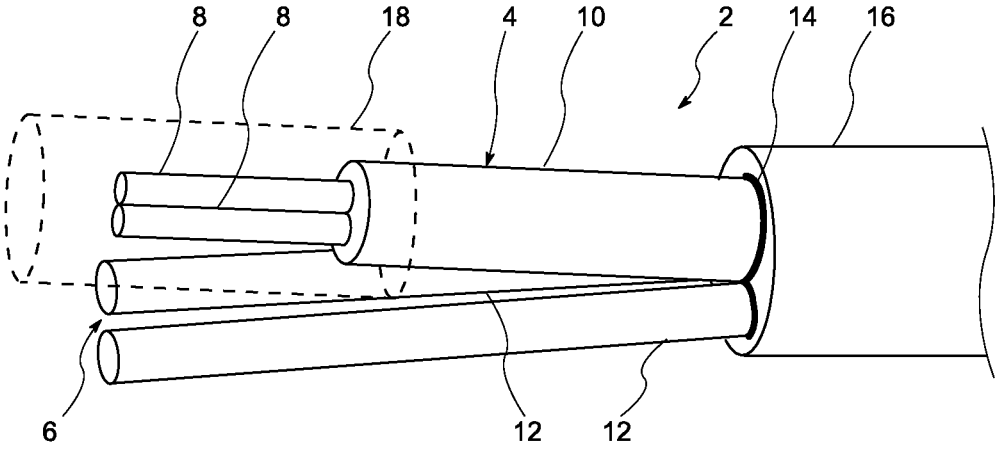
FIG. 2 is a perspective, side view of a detail of the electrical lead according to FIG. 1.

The two partial leads 4, 6 are surrounded by a common separating sleeve 14, which is illustrated as an emboldened line in FIGS. 1 and 2. The separating sleeve 14 is a separating film which is fabricated from a plastic and is guided in a longitudinally running in fashion about the partial leads 4, 6, and in this context rests in the interstices formed by the two partial leads 4, 6. Additional filler elements between the partial leads 4, 6 and the separating sleeve 14 have been dispensed with here. Both partial leads 4, 6 are finally combined by a common sheath 16, which is applied to the common separating sleeve 14. In this context, the separating sleeve 14 makes it possible, in particular, that the common sheath 16 and the partial lead sheath 10 are manufactured from the same material and nevertheless can be easily separated from one another during the preparation for fitting. The common sheath 16 also has a circular outer contour, with a diameter of approximately 10 mm here, which diameter also corresponds to the outer diameter D of the electric lead 2. The common sheath 16 is therefore also the outermost sheath of the lead 2.

FIG. 2 illustrates a section of the lead 2 according to FIG. 1 in a side illustration. The two signal conductors 8 with the partial lead sheath 10 which surrounds them and the two power conductors 12 can be clearly seen. In addition, a dashed line indicates a housing 18 of a function element, for example a rotational speed sensor. The power conductors 12 are, in contrast, provided, for example, with a suitable plug and are connected to a brake actuator (not illustrated in more detail here). The housing 18 is fabricated from the same material as the signal lead 4, in the variant shown, in particular, from a thermoplastic polyurethane polymer, and is additionally integrally molded on to the partial lead sheath 10 in a materially joined fashion, as a result of which the connection is particularly leakproof and robust. The insulation has been removed from the common sheath 16 here to such an extent that the two partial leads 4, 6 partially project and can be laid at different locations and connected as separate leads. In this context, in particular the relatively hard sheath section 10*b* ensures particularly good stability of the signal lead 4 which is guided separately.

The separating sleeve 14, which, when the insulation was removed from the common sheath 16, was also separated without residue, is also illustrated in a clearly apparent fashion in FIG. 2. Since, consequently, no residues remain on the partial lead sheath 10, the integral molding of the housing 18 onto the partial lead 4 is particularly simplified.

The lines 8*a* of the signal conductors 8 are fabricated in the exemplary refinement shown here in each case from a multiplicity of wires, which are each composed of a copper alloy. In contrast, the lines 12*a* of the power lead 6 are fabricated from copper and are constructed as limb stranded conductors by a specific stranding process.

Figure 3:
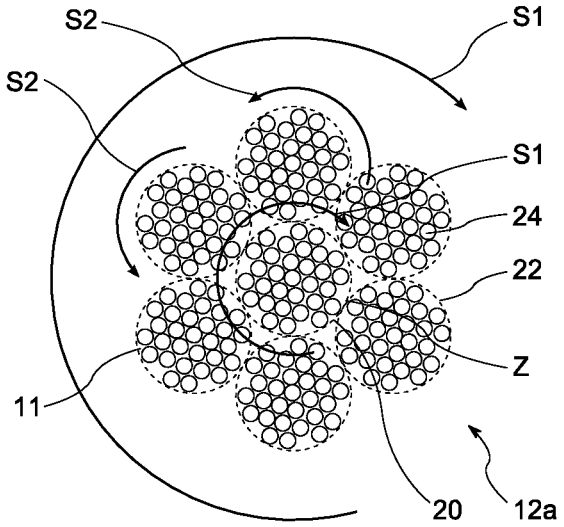
FIG. 3 is a cross-sectional view of a conductor of the electric lead according to FIG. 1, embodied as a limb stranded conductor.

In order to clarify the design of the lines 12*a* of the power conductors 12, an exemplary refinement of one of the lines 12*a* is illustrated in FIG. 3. The line is shown as a limb stranded conductor with seven limbs 20, 22 in an exemplary 1+6 stranding arrangement. The limb 20 which is arranged in the center constitutes here a central limb around which the other limbs 22 are stranded.

Each of the limbs 20, 22 contains a multiplicity of wires 24 which twist with one another in a respective limb direction of lay S1, S2. The limb direction of lay S1 of the central limb 20 corresponds here to the opposing direction of the limb direction of lay S2 of the outer limbs 22. The twisting of these outer limbs 22 around the central limb 20 additionally takes place in the opposing direction to their limb direction of lay S2, and therefore in the direction of the limb direction of lay S1 of the central limb 20. As a result, a criss-cross profile of the respective wires 24 is produced in the intermediate region Z in which a respective limb 22 bears against the central limb 20. Furthermore, as a result of the reversed lay of the outer limbs 22 with respect to their respective limb direction of lay S2, a largely straight profile of the corresponding wires 24 is produced. The power conductor 12 which is embodied in this way then has a particularly high degree of flexibility.

The following is a summary list of reference numerals and the corresponding structure used in the above description of the invention:

2 Electric lead, hybrid cable
4 First partial lead (signal lead)
6 Second partial lead (power lead)
8 Conductor (signal conductor)
8*a* Line
8*b* Conductor sheath
10 Partial lead sheath
10*a* Inner sheath section
10*b* Outer sheath section
12 Conductor (power conductor)
12*a* Line
12*b* Conductor sheath
13 Conductor separating layer
14 Separating sleeve
16 Common sheath
18 Housing (of a function element)
20 Central limb
22 Limb
24 Wire
D Outer diameter
R Total radius of the first partial lead
S1, S1 Limb direction of lay
z Intermediate region

The invention claimed is:

1. A method for connecting sensors, which comprises the steps of:

providing an electric lead, the electric lead containing at least three conductors each having a line being surrounded by a conductor sheath, two of the conductors are signal conductors, a common partial lead sheath surrounding the signal conductors, the common partial lead sheath and the signal conductors forming a first partial lead, another of the conductors is a power conductor forming a second partial lead, the electric lead further having a separating sleeve surrounding the conductors and a common sheath surrounding the separating sleeve;

connecting the first partial lead as a signal lead to a wheel rotational speed sensor in a motor vehicle; and connecting the second partial lead, as a power lead, to an electric brake actuator.

2. A method for manufacturing an electric lead, which comprises the steps of:

combining two conductors, via twisting, to form a first partial lead;

a partial lead sheath is applied jointly to the two conductors, the partial lead sheath having an inner sheath section being applied and subsequently an outer sheath section being applied, the outer sheath section is harder than the inner sheath section;

providing at least one other conductor which forms a second partial lead;

combining the first and second partial leads;

surrounding the first and second partial leads with a common separating sleeve; and applying a common sheath to the common separating sleeve.

3. The method according to claim 2, which further comprises combining the first and second partial leads by twisting.

* * * * *